US008869439B1

(12) United States Patent
Freed

(10) Patent No.: US 8,869,439 B1
(45) Date of Patent: Oct. 28, 2014

(54) FRAMELESS CONVEX HEADER

(71) Applicant: Source One Digital, Muskegon, MI (US)

(72) Inventor: James Freed, Muskegon, MI (US)

(73) Assignee: Source One Digital, Muskegon, MI (US)

( * ) Notice: Subject to any disclaimer, the term of this patent is extended or adjusted under 35 U.S.C. 154(b) by 0 days.

(21) Appl. No.: 13/648,605

(22) Filed: Oct. 10, 2012

Related U.S. Application Data

(60) Provisional application No. 61/546,578, filed on Oct. 13, 2011.

(51) Int. Cl.
*G09F 13/00* (2006.01)

(52) U.S. Cl.
USPC ..... 40/617; 406/617; 406/611.01; 406/651; 406/650

(58) Field of Classification Search
USPC ..... 160/38, 368.1, 330, 349.1, 327; 52/272, 52/287.1, 61, 277, 278; 40/606.03, 40/606.12, 610, 617, 541, 554
See application file for complete search history.

(56) References Cited

U.S. PATENT DOCUMENTS 2,920,184 A * 1/1960 Kessler ..... 362/152
3,235,926 A * 2/1966 Mates ..... 24/306
3,559,814 A 2/1971 Downing
4,313,485 A * 2/1982 Gidge et al. ..... 160/328
4,541,675 A 9/1985 Everett
4,672,757 A 6/1987 Field
4,706,820 A 11/1987 Spamer et al.
4,978,013 A 12/1990 Hogg
5,014,862 A 5/1991 Bustos
5,035,298 A * 7/1991 Noxon ..... 181/295
5,042,651 A 8/1991 Davis et al.
5,373,428 A * 12/1994 Day ..... 362/223
5,465,516 A 11/1995 Stabile
5,577,622 A 11/1996 Kapteyn
5,593,048 A 1/1997 Johnson
5,595,310 A 1/1997 Spamer et al.
6,108,956 A 8/2000 Conway et al.
6,163,899 A * 12/2000 Leonard ..... 4/558
6,189,710 B1 2/2001 Mason (Continued)

FOREIGN PATENT DOCUMENTS

EP 1 605 423 A1 12/2005

*Primary Examiner* — Casandra Davis
(74) *Attorney, Agent, or Firm* — McGarry Bair PC

(57) ABSTRACT

A frameless convex header according to the invention is installed in a conventional gondola rack display system comprising a plurality of horizontal slots or channels in a rear wall, a top wall extending normally from the rear wall and a fascia piece at the terminal edge of the top wall. A clear, preferably transparent, plastic frameless panel has a flange at one edge secured by fasteners to the top wall behind the fascia. The opposite edge of the panel (which may or may not have a flange) is lodged in a horizontal slot or channel in the rear wall, leaving the panel in a convex shape extending from the fascia to the rear wall. Preferably the panel is made of clear plastic in 4 foot widths with a thickness of about ⅛ inch. The plastic can be PETG or similar material.

16 Claims, 4 Drawing Sheets

(56) References Cited

U.S. PATENT DOCUMENTS

| | | | | |
|---|---|---|---|---|
| 6,276,034 | B1 | 8/2001 | Bachman et al. | |
| 7,007,814 | B2 | 3/2006 | Ploix | |
| 7,048,131 | B2 | 5/2006 | Gay et al. | |
| 7,150,365 | B2 | 12/2006 | Hardy et al. | |
| 7,175,034 | B2 | 2/2007 | Nook et al. | |
| D541,468 | S * | 4/2007 | Mayfield et al. | D26/120 |
| 7,451,574 | B2 * | 11/2008 | Spek | 52/288.1 |
| D683,564 | S * | 6/2013 | Vagliardo | D6/578 |
| 2006/0070285 | A1 * | 4/2006 | Grant | 40/651 |
| 2008/0172917 | A1 | 7/2008 | Brandow et al. | |

* cited by examiner

FRAMELESS CONVEX HEADER

CROSS-REFERENCE TO RELATED APPLICATION

This application claims the benefit of U.S. provisional application Ser. No. 61/546,578, filed Oct. 13, 2011, which is incorporated by reference herein in its entirety.

BACKGROUND OF THE INVENTION

Retail header displays are difficult to hang properly and require excessive hours in labor to install. It is difficult to achieve a straight, smooth and aesthetically pleasing display. Graphic panels installed in current in-use systems do not line up and are difficult to install. Other issues with known systems include material not properly fitting the display; misalignment of graphics; loss of security of graphics due to not fitting tightly and correctly; unsightly fasteners through material into the supporting rack system to hold the display in place that negatively affects the graphic image; limited ability to light the graphics; ungainly and unsightly installation and maintenance; and potential safety issues.

BRIEF DESCRIPTION OF THE INVENTION

A display header is provided for a rack display system of the type having a rear wall, a top wall extending normally from the rear wall, and a terminal flange on the top wall. The rear wall has one or more horizontal channels. The display header includes one or more flexible panels, each having a top edge, a bottom edge, and side edges. A flange is on the top edge, and the panel includes means to attach the flange to the top wall or the terminal flange. When the bottom edge is lodged in the horizontal channel the flexible panel will have a convex shape between the rear wall and the top wall to form a display header.

DESCRIPTION OF EMBODIMENTS OF THE INVENTION

While the invention and its embodiments may be used in any environment, the contemplated environment is that of a retail store display.

Figure 1:
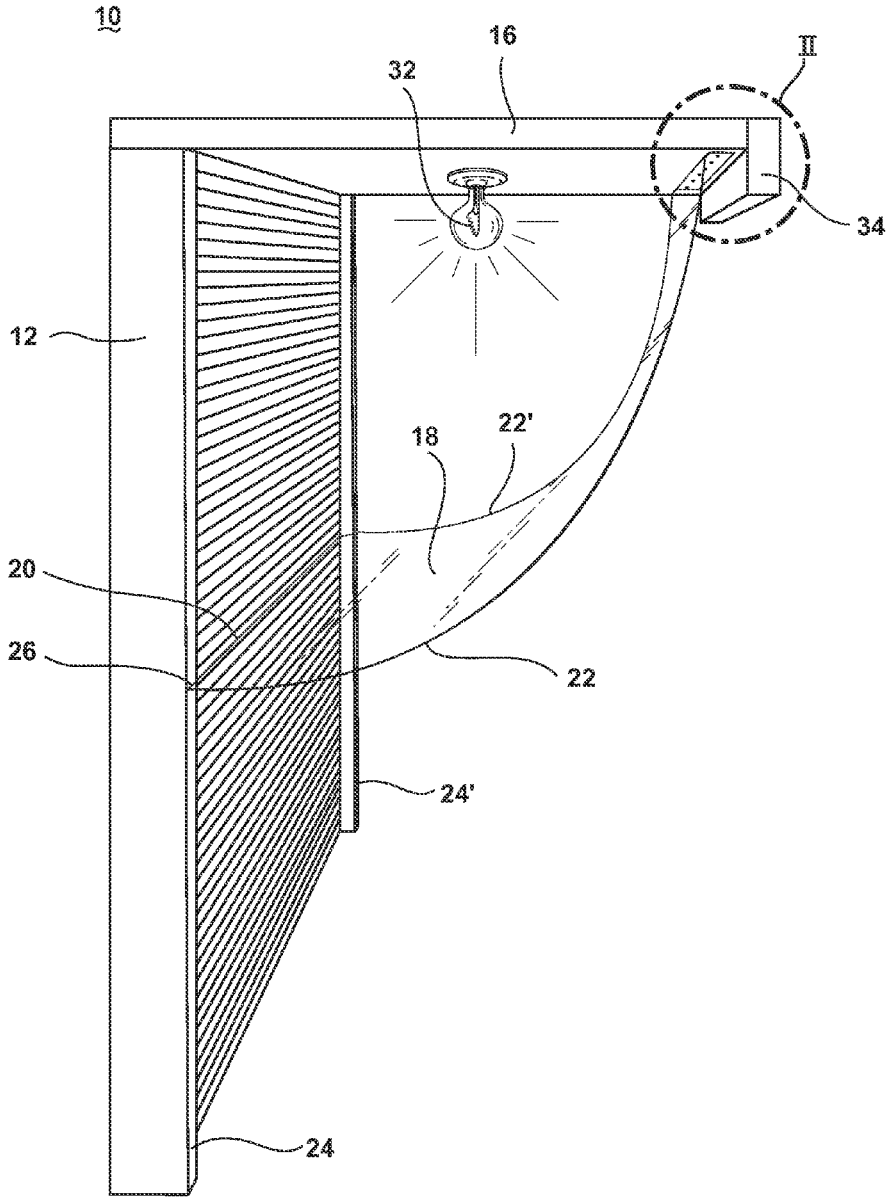
FIG. 1 is a side view of the rack display system assembly with the display header, showing a rear wall, top wall, and flexible panel.

FIG. 1 is a side view of a conventional gondola rack display system 10. The rack display system 10 comprises a rear wall 12 having a plurality of horizontal channels 14 and rack breaks 24, and a top wall 16 extending normally from the rear wall 12. The top wall 16, as illustrated, comprises at least one light bulb 32 for illuminating the rack system 10, and a front face 34 abutting the top wall 16 end opposite the rear wall 12. Any light source, including light emitting diodes (LEDs), compact florescent lights (CFLs), or natural lighting source such as a window or skylight may be used. Alternatively, there need not be a light source. Furthermore, the front face 34 for the top wall 16 is optional. The rack display system 10 is configured to allow additional rack display systems 10 to be mounted adjacently to each other. Although not show, the rack display system 10 provides for the removable installation of additional shelving or hanging mounts used in displaying retail merchandise. The rack display system 10 is well known in the industry by a person skilled in retail display.

Also shown in FIG. 1 is a display header comprising at least one flexible panel 18 having a top edge, bottom edge 20, and side edges 22. In the preferred embodiment, the flexible panel 18 made of transparent plastic in 4 foot widths with a thickness of about ⅛ inch. The plastic can be PETG or similar material. The plastic may alternatively be translucent, and should not be limited to the dimensions provided.

The flexible panel 18 having, as illustrated, having the same horizontal length as a single display rack system 10 configuration. Alternatively, the flexible panel 18 may be configured to longer or shorter lengths than the display rack system 10. The flexible panel 18 is configured between the rear wall 12 and the top wall 16 such that the panel extends convexly away from the rack display system 10.

The bottom edge 20 provides for joining said edge 20 to the rear wall 12 by means of lodging the edge 20 in the at least one horizontal channel 14. As illustrated, the means of lodging the edge 20 comprises positioning the bottom edge 20 in horizontal alignment with one horizontal channel 14 of the rear wall 12 shaped for receiving the edge 20. Any suitable joining or lodging components may be used. For example, other mechanical fasteners, e.g. bolts, nails, pins, etc. may be used as well as non-mechanical fasteners such as welding or adhesive. Furthermore, element-connector fasteners, e.g. flanges, zippers, snap-ins, or any means permanently or removably pairing the bottom edge 20 to the horizontal channel 14 are envisioned as well.

The side edges 22 of the flexible panel 18 extend normally from the bottom edge 20.

The flexible panel 18, as illustrated, additionally provides for notches 26 at each intersection of side edge 22 and bottom edge 20 corresponding to the rear wall rack breaks 24 so that the horizontal width of the flexible display 18 may extend match to the horizontal width of the rack display system 10. Alternatively, the notches 26 may be positioned on the bottom edge 20 to correspond to the rear wall rack breaks 24 wherever the breaks 24 occur.

Figure 2:
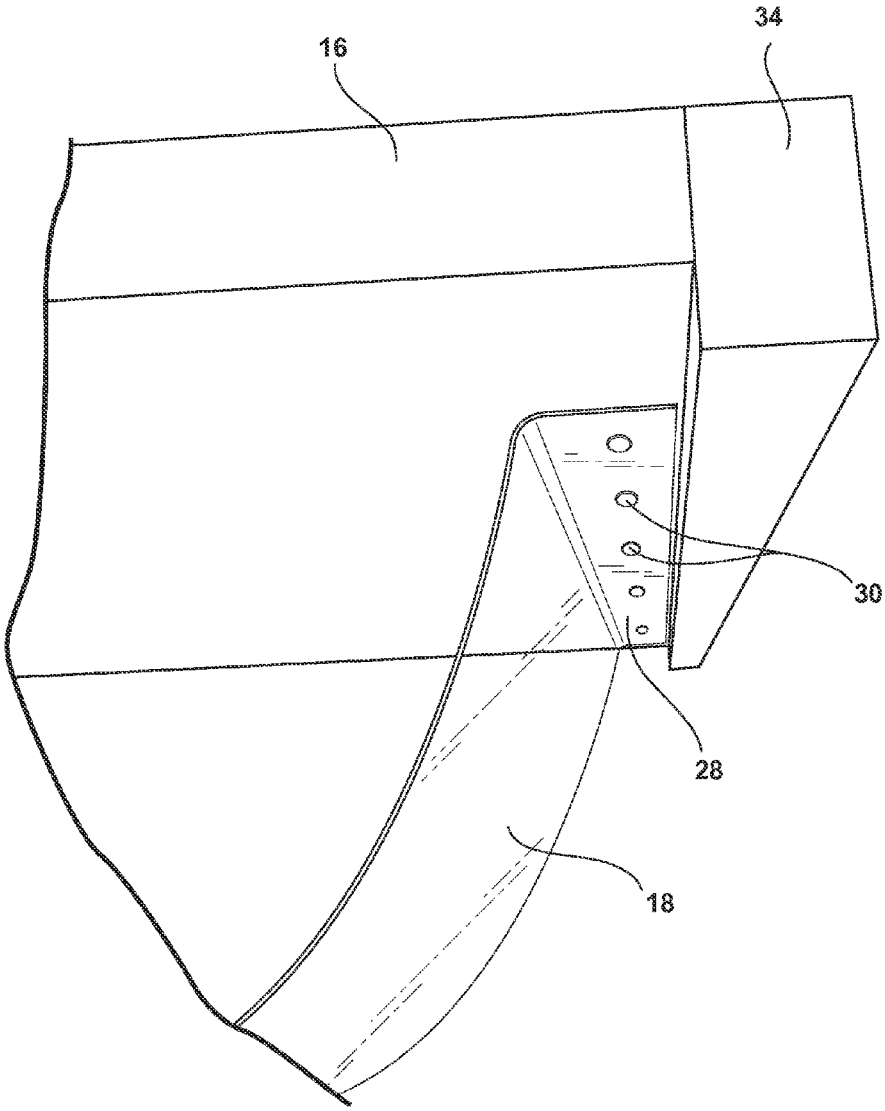
FIG. 2 is a partial perspective view of the top wall flange assembly.

Turning now to FIG. 2, the top edge of the flexible panel 18, as illustrated, comprises a flange 28 and mechanical fasteners 30 for attaching the flange 28 to the top wall 16, positioned behind the top wall front face 34. The top wall 16 correspondingly may have openings for receiving the mechanical fasteners 30. Any suitable fastening component may be used. For example, other mechanical fasteners, e.g. bolts, nails, pins, etc., may be used as well as non-mechanical fasteners, such as welding or adhesive. Alternatively, the top end flange 28 may be received by a terminal flange for mechanical or non-mechanical attachment.

Figure 3:
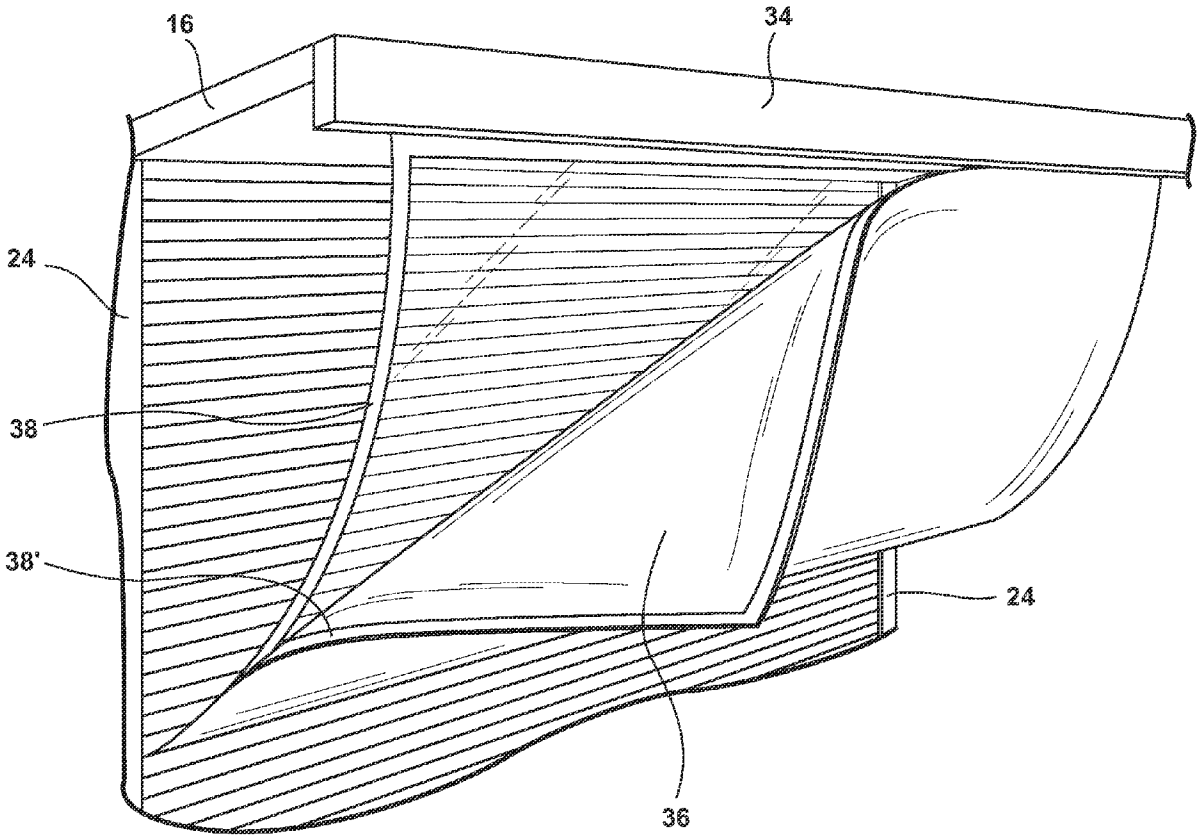
FIG. 3 is an angled view of the display header system assembly with the flexible display panel attached.

Turning now to FIG. 3, in the preferred embodiment, the flexible panel 18 is configured for removably attaching a flexible display panel 36 on the outer surface of the convex flexible panel 18, away from the rack system 10, flexible display panel 36 having graphics, words, video, or other multimedia presented. The display panel 36 is made from a plastic material constructed for receiving printed words, graphics, or other multimedia presented. The plastic may be PETG or other suitable material such as paper, banner material, film, or electronic display. The display panel 36 is configured in roughly same dimensions as the flexible display 18.

As illustrated, the means for removably attaching the flexible display panel 36 are adhesive magnetic strips 38, 38' placed both on the flexible panel 18 and the display panel 36. The magnetic strips 38, 38' are positioned on front of the flexible display 18 and on the rear side of the display panel 36 (opposite of the display side). As illustrated, the strips 38, 38' are configured on the outer frame of each panel surface and preferably not adjacent edges between panels 18, to align when the panels 18, 36 are brought into contact for retail display.

The light bulb 32 operates to illuminate the display panel 36 from behind.

Figure 4:
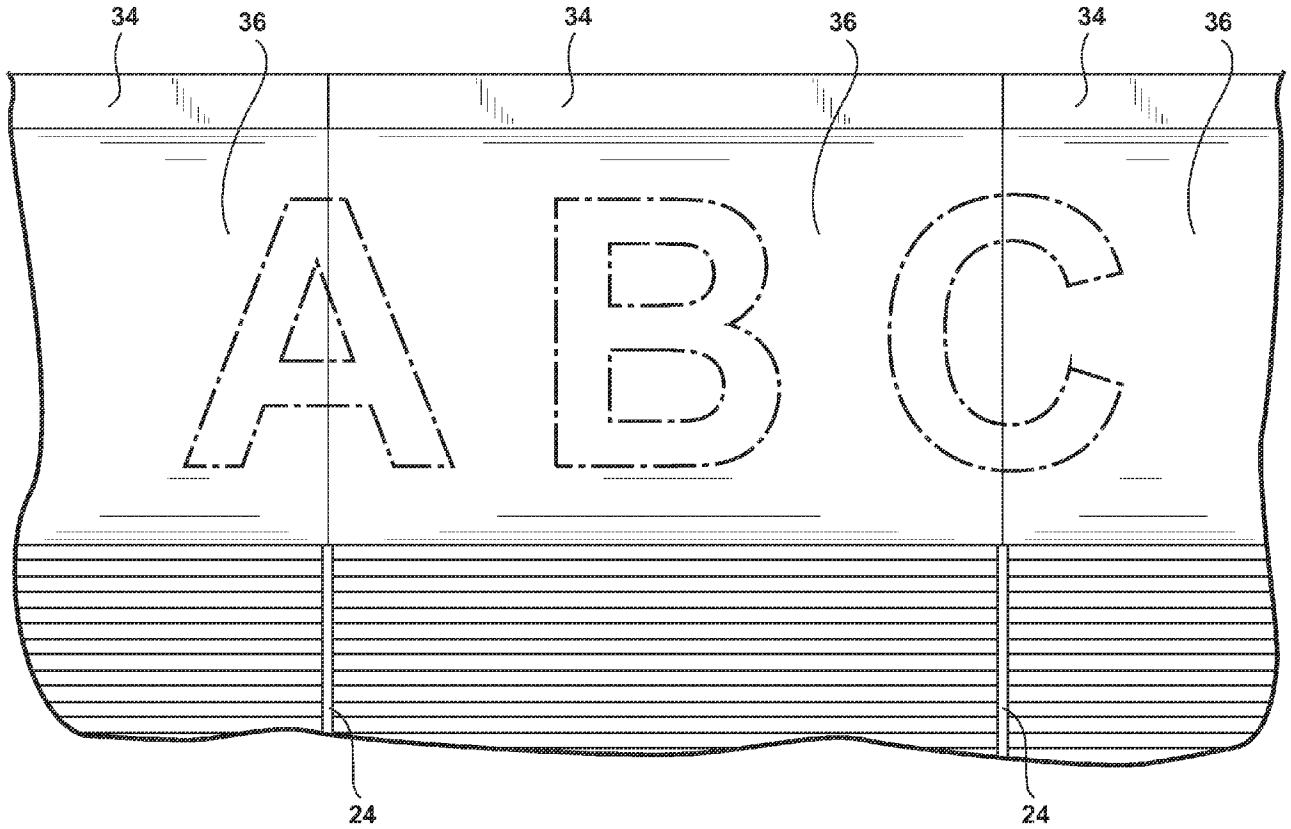
FIG. 4 is a front view of adjacent rack display system assemblies with the display header and flexible display panel attached.

As shown in FIG. 4, the rack system 10, flexible panel 18, and display panel 36 are configurable to be adjacently mounted to each other such that any adjacent display panels 36 appear seamless and free of discontinuities to the retail customer.

The display panel 36 may also be configured in different dimensions to span more than one adjacent flexible panel 18. For example, instead of a 4 foot display panel 36 aligned with a 4 foot flexible panel 18, a user could align an 8 foot display panel 36 that spans over two adjacent 4 foot flexible panels 18. In this example, the magnetic strips 38' of the display panel 36 will correspond to some of all of the magnetic strips 38 of the flexible panels 18.

In a second embodiment, not shown, there is no removable display panel 36; the flexible panel 18 additionally comprises the display words, graphics, or other media. The light bulb 32 operates to illuminate the flexible panel 36 from behind.

The rack system 10 and flexible panel 18 are configurable to be adjacently mounted to each other such that any adjacent flexible panels 36 appear seamless and free of discontinuities to the retail customer.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A display header for a rack display system having a rear wall, top wall extending normally from the rear wall, and a terminal flange on the top wall wherein the rear wall has at least one horizontal channel, the display header comprising:

at least one light transmissive flexible plastic panel having a top edge, a bottom edge, and side edges, a flange extending normally from the at least one light transmissive flexible plastic panel at the top edge, means to attach the flange to one of the top wall or the terminal flange, and indicia on the at least one light transmissive flexible plastic panel, wherein the bottom edge is configured to lodge in the horizontal channel so that when the flange is attached to the top wall or to the terminal flange, the at least one light transmissive flexible plastic panel will have a convex shape between the rear wall and the top wall as a display header with the indicia visible thereon and wherein the at least one light transmissive flexible plastic panel is mounted adjacently to a second flexible panel at the side edges.

2. The display header of claim 1 wherein the at least one light transmissive flexible plastic panel is transparent.

3. The display header of claim 1 wherein the at least one light transmissive flexible plastic panel is translucent.

4. The display header of claim 1 wherein the means to attach the flange to the top wall comprises at least one of a mechanical fastener or an opening in the top wall for receiving the mechanical fastener.

5. The display header of claim 1 wherein the means to attach the flange to the terminal flange comprises at least one of a mechanical fastener or an opening in the terminal flange for receiving the mechanical fastener.

6. The display header of claim 1 wherein the light transmissive flexible plastic panel is configured to one of display words, graphics, or video.

7. The display header of claim 1 further comprising at least one flexible display panel, and means to attach the at least one flexible display panel to the at least one light transmissive flexible plastic panel, wherein the indicia is on the at least one flexible display panel.

8. The display header of claim 7 wherein the means to attach the at least one flexible display panel to the at least one light transmissive flexible plastic panel is removable.

9. The display header of claim 7 wherein the at least one flexible display panel extends over adjacent light transmissive flexible plastic panel.

10. The display header of claim 7 wherein one of the at least one light transmissive flexible plastic panel or the at least one flexible display panel is transparent.

11. The display header of claim 7 wherein one of the at least one light transmissive flexible plastic panel or the at least one flexible display panel is translucent.

12. The display header of claim 7 wherein the at least one light transmissive flexible panel or the at least one flexible display panel is PETG.

13. The display header of claim 7 wherein the at least one flexible display panel is configured to display words, graphics, video, or other media.

14. The display header of claim 7 wherein the at least one flexible display panel is formed of at least one of plastic paper, banner material, film, or electronic display.

15. A display header for a rack display system having a rear wall, top wall extending normally from the rear wall, and a terminal flange on the top wall wherein the rear wall has at least one horizontal channel, the display header comprising:

at least one light transmissive flexible plastic panel having a top edge, a bottom edge, and side edges, a flange extending normally from the at least one light transmissive flexible plastic panel at the top edge, means to attach the flange to one of the top wall or the terminal flange, and indicia on the at least one light transmissive flexible plastic panel, wherein the bottom edge is configured to lodge in the horizontal channel so that when the flange is attached to the top wall or to the terminal flange, the at least one light transmissive flexible plastic panel will have a convex shape between the rear wall and the top wall as a display header with the indicia visible thereon and wherein the at least one light transmissive flexible plastic panel is PETG.

16. A display header for a rack display system having a rear wall, top wall extending normally from the rear wall, and a terminal flange on the top wall wherein the rear wall has at least one horizontal channel, the display header comprising:

at least one light transmissive flexible plastic panel having a top edge, a bottom edge, and side edges, a flange extending normally from the at least one light transmissive flexible plastic panel at the top edge, means to attach the flange to one of the top wall or the terminal flange, indicia on the at least one light transmissive flexible plastic panel, and means to attach the at least one flexible display panel to the at least one light transmissive flexible plastic panel, wherein the indicia is on the at least one flexible display panel wherein the bottom edge is configured to lodge in the horizontal channel so that when the flange is attached to the top wall or to the terminal flange, the at least one light transmissive flexible plastic panel will have a convex shape between the rear wall and the top wall as a display header with the indicia visible thereon and wherein the means to attach the at least one flexible display panel to the at least one light transmissive flexible plastic panel includes adhesive magnetic strips.

* * * * *